US006202375B1

(12) United States Patent
Kleinschmidt

(10) Patent No.: US 6,202,375 B1
(45) Date of Patent: Mar. 20, 2001

(54) METHOD FOR CONCRETE BUILDING SYSTEM USING COMPOSITE PANELS WITH HIGHLY INSULATIVE PLASTIC CONNECTOR

(76) Inventor: Rolf Otto Kleinschmidt, 10904 SE. 4th St., Bellevue, WA (US) 98004

( * ) Notice: Subject to any disclaimer, the term of this patent is extended or adjusted under 35 U.S.C. 154(b) by 0 days.

(21) Appl. No.: 09/182,112

(22) Filed: Oct. 27, 1998

Related U.S. Application Data

(60) Provisional application No. 60/063,686, filed on Oct. 28, 1997.

(51) Int. Cl.[7] ..... E04C 2/00

(52) U.S. Cl. ..... 52/309.11; 52/309.4; 52/309.7; 52/309.12; 52/309.16; 52/309.17; 52/309.15; 52/281; 52/379; 52/745.09; 52/745.19

(58) Field of Search ..... 52/309.11, 309.7, 52/309.12, 410, 281, 309.4, 309.13, 309.14, 309.15, 309.16, 309.17, 379, 783.1, 745.09, 745.19, 405.1, 293.3, 351, 354, 405.3, 404.2, 780, 745.1

(56) References Cited

U.S. PATENT DOCUMENTS 2,412,744 * 12/1946 Nelson ..... 52/410
4,829,733 * 5/1989 Long ..... 52/309.11
5,519,973 * 5/1996 Keith et al. ..... 52/410
5,606,832 * 3/1997 Keith et al. ..... 52/410
5,673,525 * 10/1997 Keith et al. ..... 52/309.11
5,771,649 * 6/1998 Zweig ..... 52/405.1
5,987,834 * 11/1999 Keith et al. ..... 52/410
5,996,297 * 12/1999 Keith et al. ..... 52/410
6,079,176 * 6/2000 Westra et al. ..... 52/404.2
6,112,489 * 9/2000 Zweig ..... 52/405.1

* cited by examiner

*Primary Examiner*—Carl D. Friedman
*Assistant Examiner*—Jennifer I. Thissell

(57) ABSTRACT

The present invention comprises a concrete building system with a method for fabricating composite panels using an improved design plastic connector and assembling them at the construction site to a structure which will be shotcreted on both sides to a concrete building which is highly insulated, is fire and termite proof, hurricane, earthquake and flood resistant and fulfills the requirement for flexible design. The Composite Panels are composed of two concrete layers, enclosing an insulative foam core. The skins are reinforced with wire mesh as structurally required and are connected through the foam core by structural highly insulative plastic connectors using the snap connection on both ends of the connectors so they form a tri-dimentional system and hold the wire mesh in place for the onsite shotcrete application, which includes an application of fiber for shrinkage and cracking. This replaces the welded wire fabric use for secondly reinforcing and let the wire mesh reinforcing only related to the structural strength of the composite panel. The plastic connector guarantees that no thermal bridging occurs like in other systems also the inside layer of the shotcrete panel.

6 Claims, 4 Drawing Sheets

1b
1b
B
D
C
D
1a
A
1a 7
8
12

9
7
12
8

7
9
8
10
12

METHOD FOR CONCRETE BUILDING SYSTEM USING COMPOSITE PANELS WITH HIGHLY INSULATIVE PLASTIC CONNECTOR

This application claims priority to provisional application No. 60/063,686 filed on Oct. 28, 1997.

BACKGROUND—FIELD OF INVENTION

The present invention relates in general to the field of buildings and more particularly to composite panels for concrete buildings.

BACKGROUND—DESCRIPTION OF PRIOR ART

Conventional concrete building panels are typical simple concrete slaps with imbedded reinforcement members in order to use the high compression strength from concrete together with the tensile strength of the reinforcing members.

Concrete by itself has relatively poor insulative properties although building panels have been developed in with the structural strength of concrete and reinforcing members have been combined with insulative properties.

In recent years, various techniques are developed for composite panels by combining outside concrete layers with inside insulation core and using structural members to connect them. By narrowing the methods to advanced techniques, three basic methods are found.

First, three dimensional welded wire space frame with an insulated core flanked by wire mesh connected with wire welded to the outer wire mesh layer and using field applied shotcrete This panel is manufactured by a machine which forces the wire in an angle through the insulated core and welded the wire to the flanked wire mesh. The fabricating of panels in the plant with expensive machinery is only possible by a uniform producing with high sales volume and high transport cost through an extended market. Changes of the panels are very cost-intensive.

Secondly, a three-dimensional wire frame is constructed in assembling insulated blocks in layers with wire trusses between each layer; the outer wire mesh then is clamped to the truss wire. Concrete can be field applied by shotcrete. U.S. Pat. No. 4,297,820 discloses a building structure as afore described.

Thirdly, a connector is forced through an insulation core or a prescribed pattern of holes is drilled through an insulation core through which connector rods are inserted to connect the outside concrete layers. The concrete is precast in a manufacturing plant or cast in the field in forms, or cast in form horizontal and erected in tilt up system. More advanced systems using plastic connector. U.S. Pat. No. 4,829,733 discloses a plastic shear connector with a relatively difficult method to manufacturing and use. U.S. Pat. No. 5,519,973 discloses a plastic connector that is used to connect the outer layers of concrete through an insulation core with no direct connection to the reinforcement. Both disclosures need form applied concrete.

But nevertheless, all closures heretofore known suffer from a number of disadvantages.

Steel connections like wire, truss wire or connectors, function as "thermal bridges" and can eliminate the R-value of the insulation core of up to 70%. In addition to the loss of insulation value, there is another important problem—cold spots—which can cause freeze-thaw and condensation problems.

The crack control of the concrete outer layer is preformed by wire mesh space mostly 2×2 inches for cracking, up to maximum 9 gage. This limits the structural strength for the concrete layers if formless concrete is used.

The applying technique such as field casting or precasting is complicated costly and time consuming.

The factors for the valuation of panels in these groups are high insulation value, structural strength, crack control, flexible design, easy to assemble in producing of the panels, lightweight to transport, easy to assemble on construction site, formless concrete application.

OBJECT AND ADVANTAGES OF THE INVENTION

The object of the present invention is to provide a composite panel with a method for fabricating composite panels using an improved design plastic connector and assemble them at the construction site to a structure which will be shotcreted on both sides to a concrete building which is highly insulated, provide a thermal wall storage that is fire and termite proof, hurricane, earthquake and flood resistant and fulfills the requirement for flexible design.

Still further objects and advantages will become apparent from a consideration of the ensuing description and accompanying drawings.

Building System

1—The panel is fast and easy to assemble in the plant; no expensive machinery is required: only hand tools are used. The lightweight of the panel makes the transport and unloading on to the construction site fast and efficient.

2—All material is readily available everywhere.

3—The shotcrete application has all the advantages of concrete but does not require timely construction of forms and only one finish process is required, but with many variations.

4—Multiple additives for the concrete mixtures are possible for protection or design.

5—The addition of fiber to the concrete limits the need of secondary reinforcement and use the reinforcement only for structural purpose. This allows variation of structural design.

6—Another feature of the system, lightweight steel-framing members can be assembled together in various combinations to provide efficient, versatile and structurally sound framing for non and load bearing insidewalls, floors and roofs. They offer many opportunities for savings in material cost, structural requirements, and construction time. The steel can be 100% recycled.

Connectors

1—The connector in design makes all the advantages of the panel system possible. The connector is easy to insert in the foam core of the panel, the stops and the snap connector on both sides of the connector shaft hold the connector in position for mounting the wire mesh in the required distance to the foam core for the reinforcement of the later shotcrete application.

2—The connector form with the wire mesh of the outside layers a tri-dimentional lightweight structural system that is strong for transport of any distance.

3—The high insulation value of the plastic connector and foam core allow the on-site applicated interior layer of the concrete to be a thermal storage.

4—The training time for the assembling crews for the plant and construction site is reduced to a minimum.

BRIEF SUMMARY OF THE INVENTION

The present invention comprises a composite panel with a method for fabricating composite panels using an improved design plastic connector and assembles them at the construction site to a structure, which will be shotcreted on both sides to a concrete building.

Composite Panels

Each panel has on the two major surfaces of the panel a square-welded mesh pattern of longitudinal and transverse wires of the same diameter "Welded Wire Mesh" diagonally extended highly insulative connectors spaced as required through the panel insulation core are continuously attached to the welded wire mesh using the snap connection on both ends of the connector, so they form a tri-dimentional system which greatly increases the panel strength. The snap connections at the end of connectors are designed to be inserted in a 90-degree or 45-degree angle to the wire mesh, depending on the required structural function.

The insulation core is held in the required space from each face of the wire frame to permit the wire mesh to be embedded in an application of concrete mixture including an application of fiber as for shrinkage and cracking. This replaces the welded wire fabric used for secondly reinforing and has the wire mesh reinforcing only related to the structural strength of the composite panel.

This results in the advantage for the flexible selecting of the diameter and spacing of the wire mesh only for the structural strength of a composite panel. The insulation core provides a high insulation value without thermo bridging which is increased in combination with an interior thermo storage of the interior concrete layer. The insulation core also functions as a back surface for the formless shotcrete application to receive a sprayed coating for better bonding of the concrete application to the foam core.

Method and Design of Manufacturing a Highly Insulated Connector

In a preferred design, the connector has a central shaft having at each end a snap connection for connecting the welded wire mesh with the required distance of the wire mesh to the insulation core and embedding for the concrete layer. The snap connection on both ends of the connector rod can be designed with a 45 degree angle to the connector rod; this will give a truss effect of the connector to the structure of the panel.

The connector rod including the snap connections on both sides and the stop on one side can be injection molded, resin transfer molded, or reaction injection molded in one step. The opposite later mounted stop is molded from the same material in the same mold and can be separated after the molding. This is a cost efficient process.

Another embodiment of the present invention is to produce the connector rod in an extruded rod process and mounting the injection molded snap connection at the precut rods with a shred mounting or glue mount.

Method to Assemble Composite Panels

The first step in assembling the composite panels is using a drilling frame to drill channels in pre-cut insulation blocks smaller than the diameter of the connectors to insert the connectors stiff in such channels.

The second step is to insert the connector in the insulation core. The connectors are sized to the required insulation core and concrete application, and insert in panels by using an assembling fixture to hold the panels.

The third step is mounting the wire mesh to the connectors with the required distance from the insulation core for the later embedding in the shotcrete application. The wire mesh overlaps the front and rear faces to the right or left of the vertical side for later mounting the composite panels together on the construction site.

Special composite panels for doors, windows, bathroom and kitchen walls are assembled. The assembly is vertical and not lateral with integrating frames for doors, windows and special sanitation for kitchen and bathroom walls in the panels.

Construction on Site Assembling

The lightweight panels are easily transported and assembled at the construction site to a structural custom design concrete building. The system allows the designer to effectively use in both load bearing and non-load bearing applications for walls, roofs and floors.

After the panel assembling work is completed, covering the composite panels with concrete can be achieved by a variety of methods of shotcrete. All shotcrete use and design shall comply with Section 2621 of the Uniform Building Code or AC1506 whichever is applicable.

PREFERRED EMBODIMENT DESCRIPTION

Figure 1:
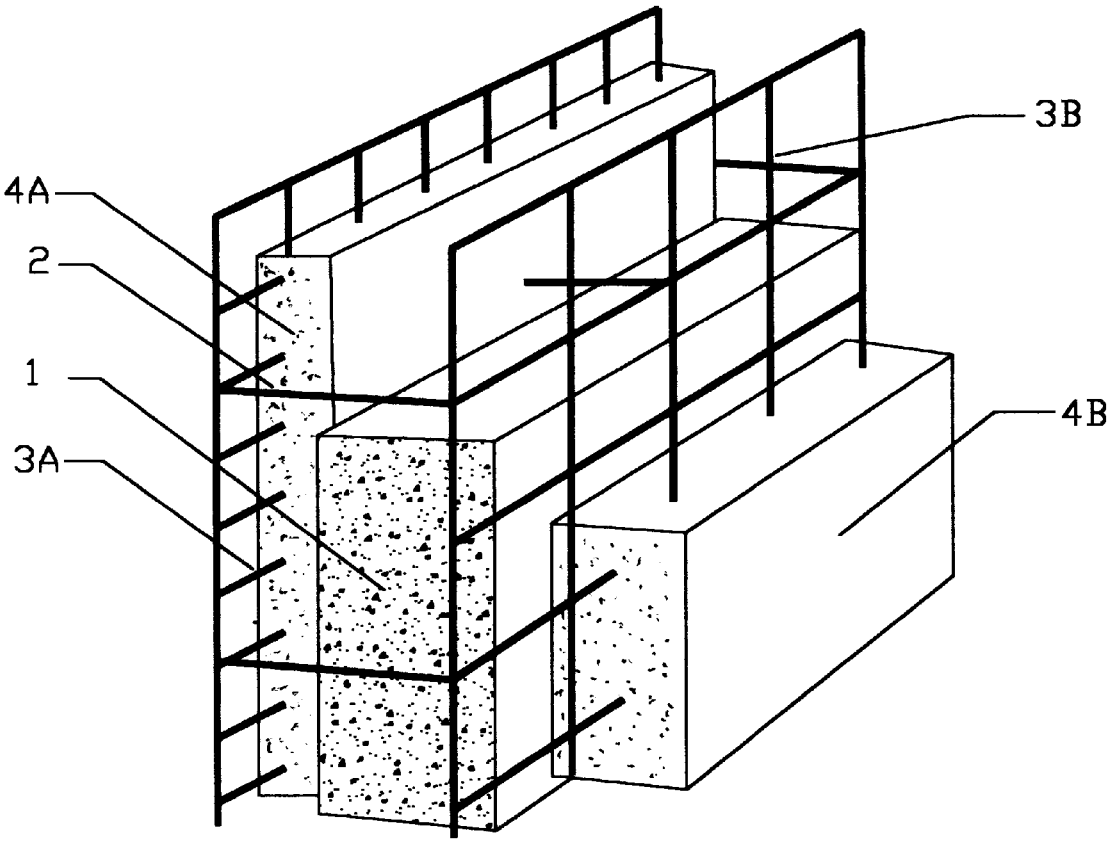
FIG. 1 is a perspective view of a composite panel using the invention.

FIG. 1 Composite Panels

FIG. 1 shows the major parts of a composite panel. Insulation core 1 with continually drilled holes (not shown) to enter highly insulative plastic connectors 2 diagonally extended through the insulation core. The snap connection on both ends of the connector are connected to welded wire mesh 3*a* and 3*b*, so they form a tri-dimentional system. The insulation core 1 also function as a back surface for a formless shotcrete application 4*a* and 4*b* including an application of fiber.

Figure 2:
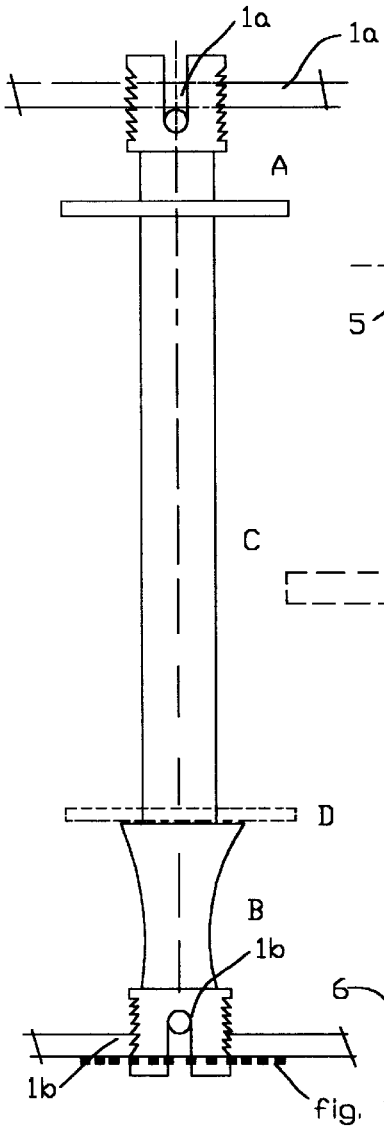
FIG. 2 is view in detail of a plastic connector used in a composite panel.

FIG. 2 Insulated Plastic Connector

Figure 2C:
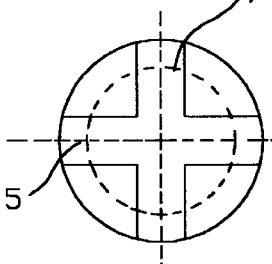
Figure 2A:
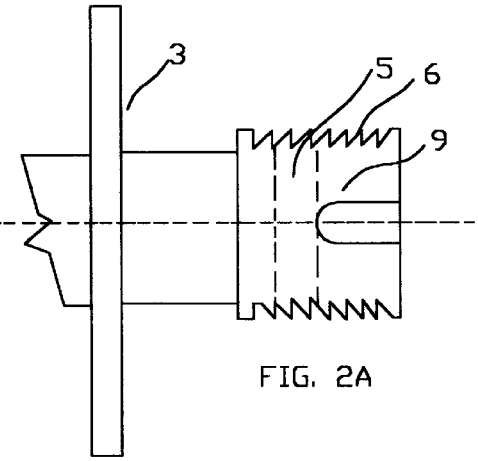
Figure 2B:
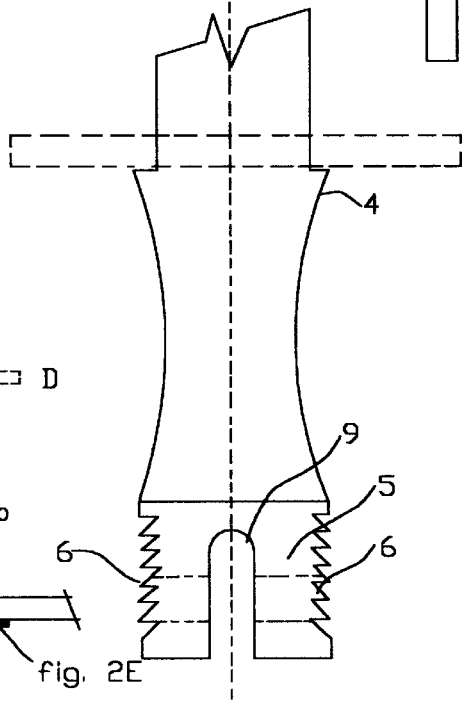

In a preferred design FIG. 2 a plastic connector has a central round plastic shaft C and at each end a head A and B in detail shown in FIG. 2A, FIG. 2B and FIG. 2C. A stop 3 is molded to Head FIG. 2A. On head FIG. 2B a snap-on stop FIG D is mounted after plastic connector FIG. 2 is inserted into the foam core FIG. 1-1, notch 4 holds stop FIG D in the required position. Heads FIG. 2A and FIG. 2B have enlarged ends 5 continually grooved 6 to receive snaphold FIG. 2E. Snap connections are grooved longitudinal 7 and transverse 8 at the end round diameter of the heads FIG. 2A and FIG. 2B in the required depth. The end of the grooves 7 and 8 have a round diameter 9 matching the diameter of the wire mesh to enter and is wider than the grooves 7 and 8 in order to have a snap affect.

Figure 3:
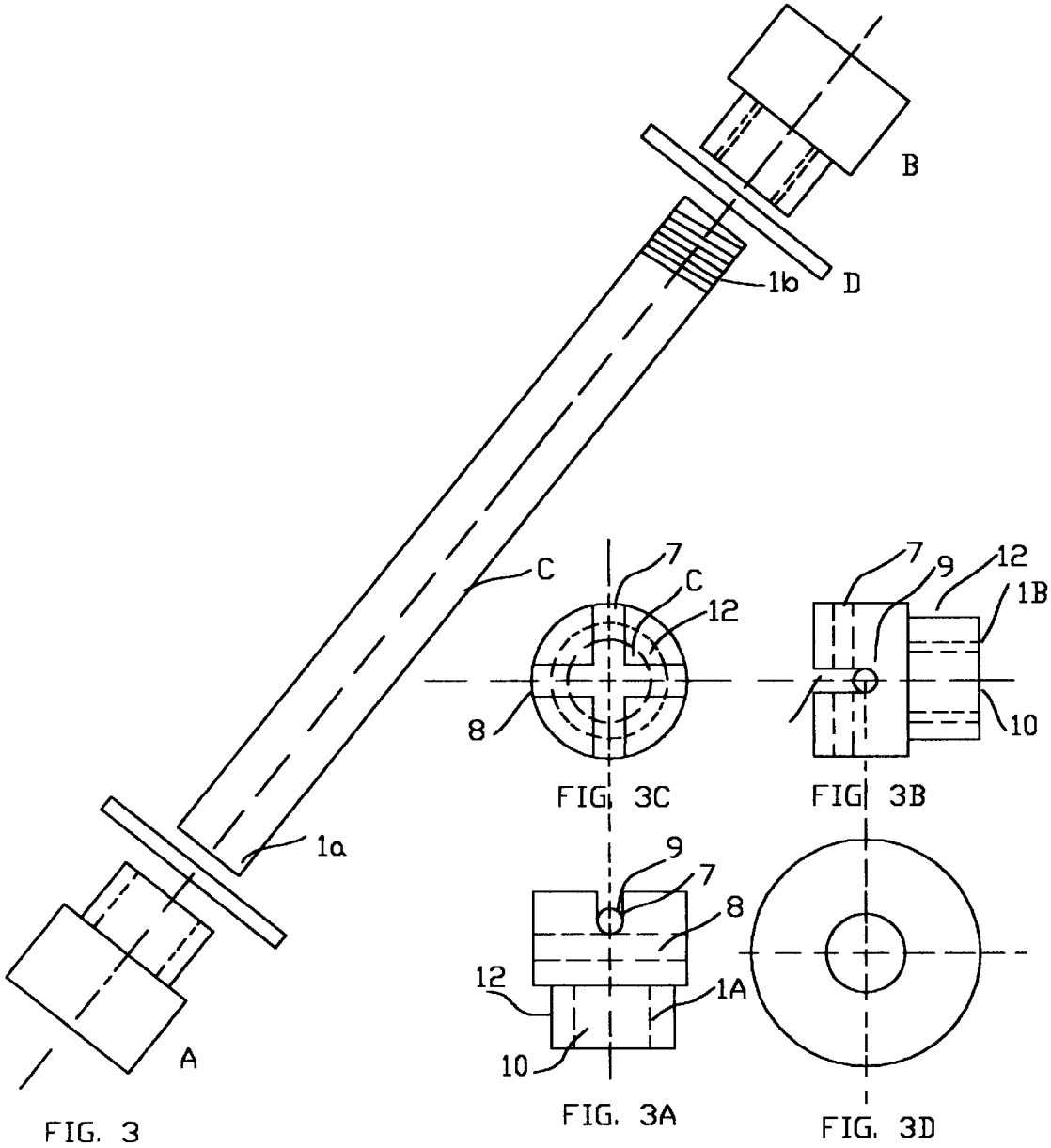
FIG. 3 is a view in detail of a plastic connector with a mounted snap head on each end.

FIG. 3 shows another embodiment of the present invention. A precut round plastic shaft C with heads B and C in detail shown in FIG. 3A, FIG. 3B and FIG. 3C are mounted at shaft C with a glue mount 1*a* or shred mounting 1*b*. Snap connectors are grooved longitudinal 7 and transverse 8 in the end diameter of heads FIG. 3A and FIG. 3B in the required depth. The end of the grooves 7 and 8 have a round diameter 9 and are wider than the grooves 7 and 8 in order to have a snap affect. Heads FIG. 3A and FIG. 3B have a hole 10 at the round end to insert the shaft C to be mounted. Washer FIG. 3D is used as stop and can be mounded on shaft C to be held by heads FIG. 3A and FIG. 3B mounting part 12 to guarantee connector FIG. 3 is held in the right position.

Figures 4, 4A, 4B, 4C, 4D:
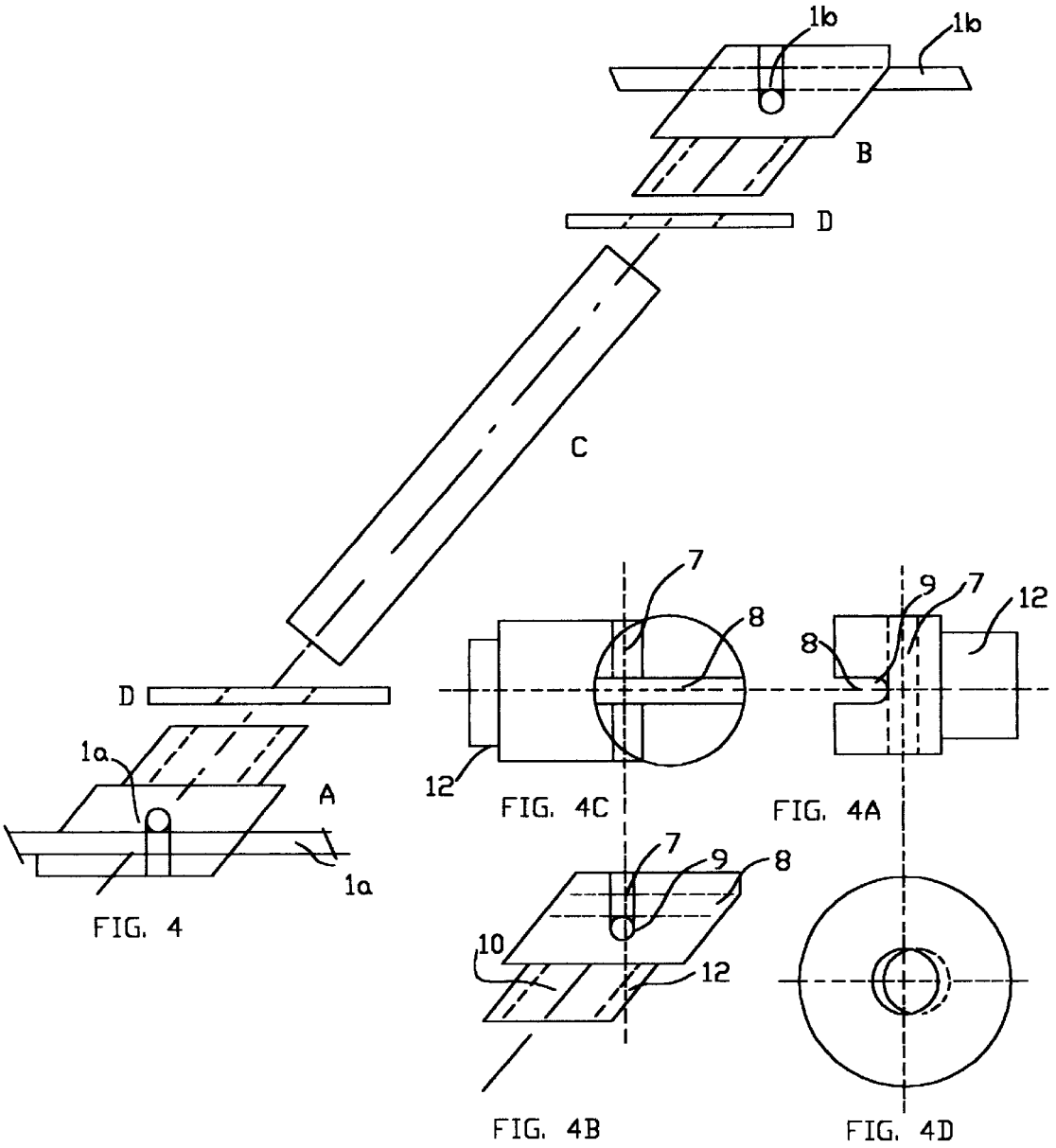
FIG. 4 is a view in detail of a plastic connector with a mounted head on each end to mount the wire mesh in a 45-degree angle.

FIG. 4 shows another embodiment of the present invention related to connector shown in FIG. 3. Precut round plastic shaft C and heads A and B in detail shown in FIG. 4A, FIG. 4B and FIG. 4C are mounted at shaft C with a 45-degree angle to shaft C. The heads FIG. 4A and FIG. 4B are grooved longitudinal 7 and transverse 8 in the end diameter of heads FIG. 4A and FIG. 4B in the required depth for to insert wire mesh at the longitudinal and transverse crossing point of the wire. The end of the grooves 7 and 8 have a round diameter 9 and are wider than grooves 7 and 8 to have a snap affect. The head FIG. 4A and FIG. 4B are have a hole 10 at the round end of the heads for to insert the shaft C to be mounted. Washer FIG. 3D is used as stop and can be inserted over shaft C and be held by heads FIGS. 3A and 3B mounting part 12 to guarantee connector FIG. 4 is in the right position.

Main Embodiment Operation

Method to Assemble Composite Panels

The first step in assembling composite panels shown in FIG. 1 is using an drilling frame (shown in a later patent application) to drill channels (not shown) in precut insulation core 1 smaller than the diameter of the connectors shown in FIG. 2 to insert the connectors 2 stiff in channels (not shown).

The second step is using an assembling fixture (shown in a later Patent Application) to hold insulation core 1 in the needed length in vertical position, to insert the connector FIG. 2 in predrilled holes (not shown) in insulation core 1. Plastic Connectors FIG. 2 are sized to the width of a required insulation core 1 and shotcrete application 4*a* and 4*b*. Stop 3 heads FIG. 2A and FIG D are used to hold the plastic connector FIG. 2 in the right position to mount the wire mesh 3*a* and 3*b* for the later embedding in the shotcrete application 4*a* and 4*b*

The third step is mounting the wire mesh 3*a* and 3*b* to connectors FIG. 2 with the required distance from the insulation core. Connectors FIG. 2 are continuously attached to wire mesh 3*a* and 3*b* using the snap connections 7 and 8 on both ends of the connector heads 2*a* and 2*b*, so they form a tri-dimentional system which greatly increases the panel strength and hold the lightweight panel system together. The wire mesh 3*a* and 3*b* overlap the front and rear faces of panel FIG. 1 to the right or left of the vertical side, for later mounting the composite panels together at the construction site. Snap connections at the end of connectors FIG. 2, FIG. 3, FIG. 4 heads 2*a* and 2*b* are designed to be inserted in a 90 degree or 45-degree angle to the wire mesh, depending on the required structural function.

Special composite panels are assembled in a fixture (shown in a later patent application) for doors, windows, bathroom and kitchen walls. The assembly is vertical and not lateral with integrating frames for doors, windows and special sanitation for kitchen and bathroom walls in the panels.

Method of On-Site Construction and Panel Assembling (Design Patent shown in a later patent application)

The lightweight panels FIG. 1 are easily transported and assembled at the construction site to a structural custom design concrete building. The system allows the designer to effectively use in both load bearing and non load bearing applications for walls, roofs and floors.

A plurality of metal anchors, continually be placed in the wall footings or slab are used to secure the panel bases and hold the panels in position, length of rebar bended in a right angle extending vertically out of the interior layer of the panels at the panel base, connect the panels to the slab floor, tops corners or ends of the panels are connected with pre-formed pieces of wire mesh.

The first two panels are placed on line, forming a corner and the adjacent panels are clamped together using a pneumatic fastener tool at the overlapping wire mesh surfaces of the wire frame.

After the first two panels are firmly attached, the panel tops can be brought on line using appropriate parching.

Connection to roofs and floors or tops or ends are pieces of wire mesh pre-formed with required bends.

Another feature of the system is the accommodation of utilities. The panels receive grooved channels following the custom design, performed with hot wire grooves, to receive electrical conduit and water pipe, gas lines, phone cable, etc. The channels perform insulation and tie fastening without fastener.

Shotcrete Application

After the panel assembling work is completed, covering the composite panels with concrete can be achieved by a variety of methods of shotcrete. The insulation core 1 of panel shown in FIG. 1 is held by plastic connectors FIG. 2 in the required space from each face of the wire frame to permit the wire mesh 3*a* and 3*b* to be embedded in an application of concrete mixture 4*a* and 4*b* including an application of fiber as required for shrinkage and cracking. This replaces the welded wire fabric use for secondly reinforcing, and results in the advantage for the flexible selecting of the diameter and spacing of the wire mesh only for the structural strength of composite panel FIG. 1. The insulation core 1 provide with plastic connector FIG. 2 high insulation value without thermo bridging. Interior concrete applications 4*b* also function as a thermo storage which increase the passive R value of insulation core 1 substantial. Insulation core 1 function also as back surface for the formless shotcrete application 4*a* and 4*b* and will receive a sprayed coating for better bonding of the concrete application to the insulation core. Multiple additives for the concrete mixtures are possible for protection or design.

All shotcrete use and design shall and can comply with Section 2621 of the Uniform Building Code or AC1506 whichever is applicable.

Another feature of the system is lightweight steel framing members can be assembled together in various combinations to the composite panel system to provide efficient, versatile and structurally sound framing for non and load bearing inside walls, floors and roofs. They offer many opportunities for savings in material cost, structural requirements, and construction time. Steel can be 100% recycled.

Method and Design of Manufacturing a Highly Insulated Connector

In a preferred design shown in FIG. 2, a plastic connector has a round plastic shaft C having at each end heads FIG. 2A and FIG. 2B with snap connection. A stop 3 is molded to head FIG. 2A to stop the connector to enter farther as required in insulation core 1 (FIG. 1). On the opposite end on head FIG. 2B a Snap-On stop FIG D is mounted after plastic connector FIG. 2 is inserted into the insulation core 1 (FIG. 1) to hold connector FIG. 2 in position for connecting the welded wire mesh (FIG. 1) 3*a* and 3*b* in the required distance to the insulation core 1 (FIG. 1). Notch 4 (FIG. 2B) lock stop (FIG. 2D) in the required position after entering. Head FIG. 2A and FIG. 2B have enlarged ends 5 continually grooved 6 to hold the heads FIG. 2A and FIG. 2B in the concrete and secondly for snaphold FIG. 2E to be mounted, if a wire mesh with smaller diameter as design in the snap connector is used. Snap connection are grooved longitudinal 7 and transverse 8 at the end round diameter of the heads FIG. 2A and FIG. 2B in the required depth, for to insert wire mesh 3*a* and 3*b* (FIG. 1) at the longitudinal and transverse crossing point of the wire as shown in FIG. 2. 1*a* and 1*b*. The end of the grooves 7 and 8 have a round diameter 9 matching the diameter of the wire mesh to be entered and is wider than the grooves 7 and 8 to have a snap affect.

Figure 2D:
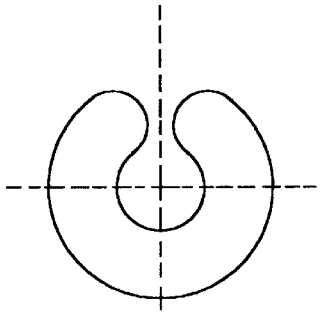
Figure 2E:
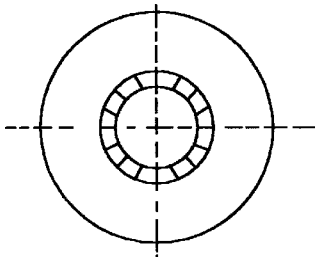

The connector rod C including the heads FIG. 2A and FIG. 2B and the stop on one side can be injection molded, resin transfer molded, or reaction injection molded in one step. The opposite later mounted stop FIG. 2D is molded from the same material in the same mold and can be separated after the molding; this is a cost efficient process.

FIG. 3 shows another embodiment of the present invention. The connector shaft C (FIG. 3) is formed in an pulltruded rod process, heads FIG. 3A and FIG. 3B are injection molded and mounted at the precut rods with a shred mounting or glue mount. Snap connectors are grooved longitudinal 7 and transverse 8 in the end diameter of heads FIG. 3A and FIG. 3B in the required depth for to insert wire mesh at the longitudinal and transverse crossing point of the wire mesh. The end of the groove 7 and 8 has an round diameter 9 matching the diameter of the wire mesh and is wider than the grooves 7 and 8 to have a snap affect. Heads FIG. 3A and FIG. 3B have a hole 10 at the round end to insert the shaft C to shred or glue mounted. Washer FIG. 3D is used as stop and can be insert over shaft C and be held by heads FIGS. 3A and 3B mounting part 12 to guarantee that connector FIG. 3 is in the right position.

FIG. 4 shows another embodiment of the present invention related to connector shown in FIG. 3. Precut round plastic shaft C is formed in a pulltruded rod process and the injection molded heads FIG. 4A and FIG. 4B are mounted with a shred or glue mount to shaft C in a 45-degree angle to shaft C. The heads FIG. 4A and FIG. 4B are grooved longitudinal 7 and transverse 8 in the end diameter of heads FIG. 4A and FIG. 4B in the required depth for to insert wire mesh at the longitudinal and transverse crossing point of the wire. The end of the grooves 7 and 8 have a round diameter 9 matching the diameter of the wire mesh and is wider than groove 7 and 8 for to have a snap affect. The heads FIG. 4A and FIG. 4B have a hole 10 at the round end of the head for to insert the shaft C to be mounted. Washer FIG. 3D is used as stop and can be inserted over shaft C and be held by heads FIGS. 3A and 3B mounting part 12 to guarantee that connector FIG. 4 is in the right position.

What is claimed is:

1. A composite building system comprising composite panels having two outer structural layers of formless applied shotcrete concrete and a high thermo-resisting insulating core, highly insulative plastic connectors extend diagonally through the insulative core to wire mesh that is located on both sides of the core at a distance away from the core, the wire mesh is substantially embedded in the concrete with a portion that is not embedded extending out of the concrete on at least one side for further connection to other panels, the plastic connectors having a shaft and two ends with snap connections on both ends of the shaft that connect the wire mesh on both sides of the core, holding the outside layers of the composite panels so it forms a tri-dimensional structural system, both sides of the panels are formless shotcrete concrete, and multiple additives are part of the concrete mixture for protection.

2. A concrete building system as in claim 1, the plastic connectors further comprising a shaft with a mounted stop inserted in the insulative core and a snap stop to hold the connectors in the required position in the insulative core, both ends of the shaft have a snap connector for mounting reinforcement of the outside layers of the composite panels, said connectors further comprising a cured resinous or plastic material with a high thermal resistance.

3. A concrete building system as in claim 1, the plastic connectors further comprising a shaft with mounted heads which hold the connectors in position, snap connections reinforce and hold the outside layer of the composite panel, the shaft may be formed by extrusion, pultrusion, or compression molding, and the heads may be formed by injection molding or compression molding.

4. A concrete building system as in claim 3, the plastic connectors further comprising heads holding the connectors at a 45-degree angle to the wire mesh.

5. A method for assembling composite panels of claim 1, steps including assembling composite panels by drilling channels in pre-cut insulation core, the channels being smaller than the diameter of the connectors, inserting the connectors in the channels, holding the insulative core at the desired length in order to insert the connectors, in the insulative core the plastic connectors are sized to the width of the required insulative core, stops are used to hold the plastic connectors in a position to mount the wire mesh for later embedding the mesh in the shotcrete application, mount the wire mesh to the connectors at the required distance from the insulative core, the connectors are continuously attached to the wire mesh using the snap connections on both ends of the connectors shaft forming a tri-dimensional system which greatly increases the panels strength and holds the panels together, the wire mesh overlaps the front and rear faces of the panel to the right or left of the vertical side for mounting the panels together, snap connections at the end of the connectors are inserted at a 90-degree angle or a 45-degree angle to the wire mesh, the composite panels are assembled for doors, windows, and bathroom and kitchen walls.

6. A method for assembling the composite panel of claim 1, steps including placing two panels in line to form a corner, clamping adjacent panels together with overlapping wire mesh at the right and left side of the panels, a plurality a metal anchors are continuously placed in a footing or slab and are used to secure the panel bases and hold the panels in place, lengths of rebar are bent at right angles extending vertically out of the concrete layer of the panels at the base of the panels, connecting the panels to the tops, corners, or ends of the panels, the panels are connected with pre-formed pieces of wire mesh, the panels receive grooved channels for receiving electrical conduit and water pipes, gas lines, and phone cables, the channels insulate and tie fasten without a fastener, after assembling the panels cover the composite panels with concrete by shotcrete application, the insulative core of the panels is held by a plastic connector in the space from each face of the wire frame to permit the wire mesh to be embedded in the application of concrete, the concrete mixture including an application of fiber to prevent shrinkage and cracking, resulting in flexible selection of the diameter and spacing of the wire mesh for the strength of the panels, multiple additives can be placed in the concrete mixture for protection.

* * * * *